US009623279B2

(12) United States Patent
Domeika et al.

(10) Patent No.: US 9,623,279 B2
(45) Date of Patent: Apr. 18, 2017

(54) UNSTABLE ROWING SIMULATOR

(71) Applicant: UAB "ABILI", Kaunas (LT)

(72) Inventors: Aurelijus Domeika, Kaunas (LT); Vytautas Grigas, Kaunas (LT); Pranas Ziliukas, Kauno r. (LT)

(73) Assignee: LAUNAS UNIVERSITY OF TECHNOLOGY, Kaunas (LT)

( * ) Notice: Subject to any disclaimer, the term of this patent is extended or adjusted under 35 U.S.C. 154(b) by 0 days.

(21) Appl. No.: 14/433,102

(22) PCT Filed: Dec. 31, 2012

(86) PCT No.: PCT/LT2012/000010
§ 371 (c)(1),
(2) Date: Apr. 2, 2015

(87) PCT Pub. No.: WO2014/054931
PCT Pub. Date: Apr. 10, 2014

(65) Prior Publication Data

US 2015/0258366 A1 Sep. 17, 2015

(30) Foreign Application Priority Data

Oct. 2, 2012 (LT) ..... 2012 089

(51) Int. Cl.
*A63B 69/06* (2006.01)
*A63B 69/08* (2006.01)
(Continued)

(52) U.S. Cl.
CPC ..... *A63B 22/0076* (2013.01); *A63B 22/0087* (2013.01); *A63B 22/14* (2013.01);
(Continued)

(58) Field of Classification Search
CPC ..... A63B 22/0076; A63B 22/14; A63B 22/16; A63B 2022/0082; A63B 2022/0084;
(Continued)

(56) References Cited

U.S. PATENT DOCUMENTS 199,432 A * 1/1878 Goldie ..... A63B 22/0076 482/114
228,800 A * 6/1880 Barker et al. ..... A63B 22/0076 482/63
(Continued)

FOREIGN PATENT DOCUMENTS

NO WO 2004112918 A1 * 12/2004 ..... A63B 21/0083
WO 2009/097452 A2 1/2009

OTHER PUBLICATIONS

Domeika A et al.: "Unstable simulator of academic rowing", Mechanika, Kauno Technologijos Universitetas, LT, vol. 79. Sep. 1, 2009 (Sep. 1, 2009), pp. 48-51. XP009170427, ISSN: 1392-1207 cited in the application the whole document.
(Continued)

*Primary Examiner* — Joshua Lee
(74) *Attorney, Agent, or Firm* — Young & Thompson

(57) ABSTRACT

Lever-type rowing machine, whose main rigging dimensions meet the corresponding parameters of sweep rowing or sculling boat is mounted to the base frame by using front and rear elastic suspension so that the simulator makes it possible to rotate (tilt) about its transverse and longitudinal axes and move vertically, thus making it possible to simulate the boat swings on the transverse and longitudinal axes and movement in the vertical direction. In addition, the simulator has passive and active stabilization systems, enabling the athlete to maintain a balance, and stiffness of its front and rear suspension and stabilizer system can be adjusted depending on the weight and balancing ability of user. There is also a possibility to constraint the suspension thus ensur-
(Continued)

ing full stability of the simulator and exercise regime, corresponding to the exercising on common rowing machines.

3 Claims, 1 Drawing Sheet

(51) Int. Cl.

| | |
|---|---|
| ***A63B 22/00*** | (2006.01) |
| ***A63B 71/00*** | (2006.01) |
| ***A63B 21/008*** | (2006.01) |
| ***A63B 22/14*** | (2006.01) |
| ***A63B 22/16*** | (2006.01) |

(52) U.S. Cl.
CPC ..... *A63B 22/16* (2013.01); *A63B 69/06* (2013.01); *A63B 21/008* (2013.01); *A63B 2022/0041* (2013.01); *A63B 2022/0082* (2013.01); *A63B 2069/064* (2013.01); *A63B 2220/70* (2013.01)

(58) Field of Classification Search
CPC ..... A63B 69/06; A63B 2069/064; A63B 2069/066; A63B 2069/068; A63B 2022/0041; A63B 2022/0079; A63B 22/0087; A63B 21/008; A63B 21/158; A63B 21/159; A63B 21/4043; A63B 21/4045; A63B 21/4047; A63B 21/4049; A63B 22/0002; A63B 22/0005; A63B 22/0007; A63B 22/001; A63B 22/0012; A63B 22/0015; A63B 22/0025; A63B 22/0046; A63B 22/0048; A63B 22/0064; A63B 22/0066; A63B 22/0069; A63B 22/0089; A63B 22/18
USPC ..... 482/72
See application file for complete search history.

(56) References Cited

U.S. PATENT DOCUMENTS

| | | | | | |
|---|---|---|---|---|---|
| 335,597 | A * | 2/1886 | Libbey | A63B 22/0076 | 482/72 |
| 457,602 | A * | 8/1891 | Coop | A63B 22/0076 | 482/73 |
| 1,504,375 | A * | 8/1924 | Phillips | A63B 22/0076 | 482/112 |
| 1,966,848 | A * | 7/1934 | Charters | A63B 22/0076 | 482/73 |
| 3,266,801 | A * | 8/1966 | Johnson | A63B 22/0076 | 482/112 |
| 4,621,623 | A * | 11/1986 | Wang | A63B 22/0076 | 482/73 |
| 4,650,181 | A * | 3/1987 | Yang | A63B 22/0076 | 482/148 |
| 4,743,011 | A * | 5/1988 | Coffey | A63B 21/0088 | 482/111 |
| 4,795,147 | A * | 1/1989 | Seal | A63B 22/0076 | 482/73 |
| 4,984,986 | A * | 1/1991 | Vohnout | A63B 24/00 | 434/247 |
| 5,092,581 | A * | 3/1992 | Koz | A63B 69/06 | 434/247 |
| 5,441,469 | A * | 8/1995 | Chern | A63B 22/0076 | 482/72 |
| 6,679,814 | B2 * | 1/2004 | Chung-Ting | A63B 21/0083 | 482/72 |
| 7,833,136 | B2 * | 11/2010 | Bell | A63B 21/154 | 482/138 |
| 7,946,964 | B2 * | 5/2011 | Gothro | A63B 22/16 | 434/60 |
| 8,109,859 | B2 * | 2/2012 | Medina | A63B 22/0076 | 482/148 |
| 2003/0166438 | A1 * | 9/2003 | Gramaccioni | A63B 21/225 | 482/72 |
| 2005/0164848 | A1 * | 7/2005 | Carbone | A63B 22/0076 | 482/92 |
| 2007/0197347 | A1 * | 8/2007 | Roach | A63B 22/0076 | 482/72 |
| 2008/0280736 | A1 * | 11/2008 | D'Eredita | A63B 21/154 | 482/72 |
| 2011/0245044 | A1 * | 10/2011 | Kelliher | A63B 21/154 | 482/72 |
| 2012/0196727 | A1 * | 8/2012 | Larsson | A63B 69/06 | 482/72 |
| 2013/0017932 | A1 * | 1/2013 | Tayebi | A63B 69/06 | 482/94 |

OTHER PUBLICATIONS

International Search Report, dated Aug. 5, 2013, from corresponding PCT application.

* cited by examiner

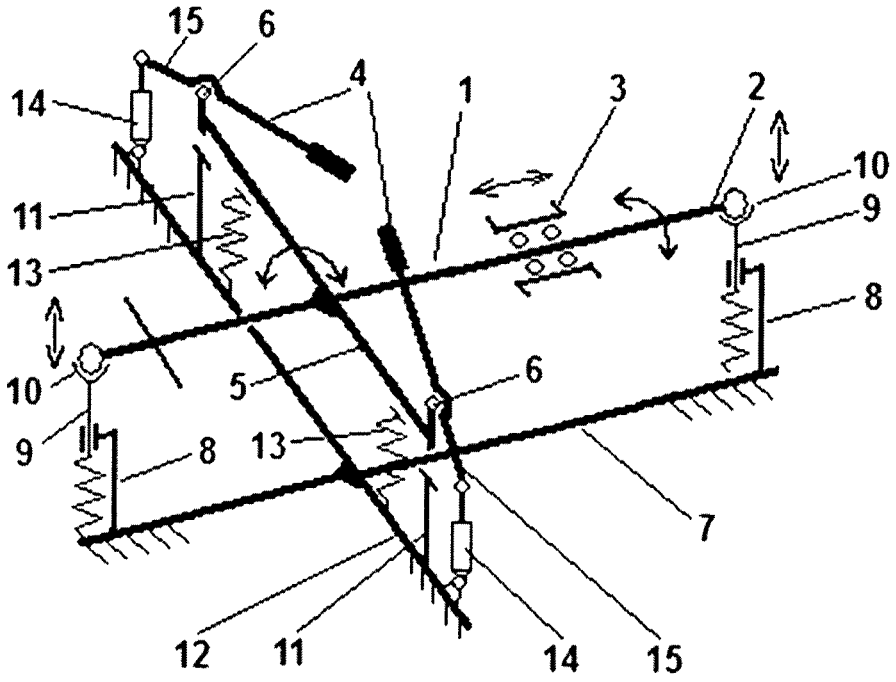
15
6
4
1
3
2
14
10
11
9
13
8
10
5
6
9
8
13
7
12
11
14
15

UNSTABLE ROWING SIMULATOR

FIELD OF THE INVENTION

The invention relates to mechanical and mechatronic systems engineering and technology. The device is designed to develop the human physical condition, including coordination of movements.

This invention relates generally to exercise machines and, more particularly, to an improved exercise rowing simulator.

BACKGROUND

The more and more attention to human well-being, functional capacity, health promotion, treatment and rehabilitation is paid in today's society. Optimal interoperability of the human and technical means, the knowledge in helping human to maximize the use of physiological power come in handy for the best sports results or simply right physical condition. Strengthening the human's movements speed, muscles force and endurance is of the utmost importance in both cases. In general it may be ensured by physical exercising, but for high performance in sports the co-ordination of movements and exercise technique are also very important.

The free weights, balls (Swiss ball), special balance platforms and other special measures are used to improve coordination of movements and develop the balance maintaining capability. The movements of the athlete are not restrained by any technical means when exercising with the free weights, so body-mass system balance must be ensured by appropriate muscles activity. Meanwhile, most of the exercising machines used for training muscles power and endurance are dedicated to specific groups of muscles, which are trained by repeating simple movements during which the inertial mass is moved (weight lifted), and its balance is ensured (or trajectory kept) by technical means (guides and so on). So for the athlete it is enough only to move the weights overcoming the gravity or inertia forces. The possibilities of such universal power training equipment are limited also due to fact that they usually imply performing of movements which not conform to the movements characteristic of any particular sport.

While achieving high sports results it is important to educate not only the overall strength and endurance, but also to improve motion technique, which in most cases has a significant impact too. Therefore it is important to develop exercising machines—simulators for specific sports, for example—rowing (canoe-kayak, sweep-rowing, sculling etc.). In this case one more specific problem becomes relevant, namely—stability, because in real conditions (boat floating in water) a substantial instability is characteristic to boat-athlete system. In this instance the athlete must balance the whole system (unlike during strength training with free weights, when only the weight should be guided) what is quite difficult due to the absence of firm ground, because the rower sits in the boat free to float in the water, and the balance may be kept only in two ways—by changing the pose or position of the body and by using oars movements or their blades interaction with water. The exclusive positive feature of unstable exercising—workouts that require a body balancing makes additional affect on nervous system, more muscles are trained and it is done more effectively than during the common workouts with dumbbells. The best example of this type of exercising is rowing of the unstable boat floating in the water. It is recognized that rowing—one of the most effective and most sustainable ways of training human endurance and strength. The rower has to maintain a balance, coordinate the movements and control the force of all the muscles involved in rowing since all these factors have a significant impact on the workout or race result. Scientific studies of D. Behman, J. Kollmitzer, C. Richardson et all confirmed that muscle strength training does not always improve their balancing function, instability during power workouts causes higher exertion of muscles, promotes neuromuscular system to adapt and improves coordination, and consentaneous training of balance and strength enhances motion control and muscles activity (strength and stability).

However, almost all rowing simulators created so far both for amateur and professional athletes are of stable type. This and other deficiencies stimulate the search of methods to improve the training process, refine rowing technique to reduce muscle, ligament or joint injuries and other risks. One of such methods is the development of new training equipment basing on results of the research of biomechanical and physiological parameters of human body movements.

Having the aim to maximize performance of the rowing exercisers to this regard the development of unstable rowing simulators recently started, starting from the simplest equipped with an "adjustable stability seat" seat Core Perform, having a possibility to sway around its longitudinal axis (Rowing News, June 2008, Volume 15, # 4), or, as in case of rowing simulator, patented in 2009 by authors from the U.S. (Adjustable lateral instability feature for rowing simulator (International Publication Number WO2009/097452 A1, Jun. 8, 2009), where the whole machine is able to sway around a horizontal longitudinal axis. However, in the first case a stable footrest which cannot be found in a boat helps maintain the balance, in the second—the kinematic of oarsman movements is different than in the real boat and the only axis of swaying is available (ensuring only lateral instability), to ensure minimum stability being located slightly above the center of masses of athlete-rowing machine system, so the system instability not quite meet instability of boat floating in the water, because realistically a boat even while going straight moves up and down and rotates about all three coordinate axes. Almost all these conditions are met in the rowing simulator, described in the article "Unstable simulator of academic rowing (A. Domeika, V. Grigas, P. Žiliukas and A. Vilkauskas // Mechanics of the Kaunas University of Technology, Lithuanian Academy of Sciences, Vilnius Gediminas Technical University. Kaunas: Technologija. ISSN 1392-1207, 2009, no. 5 (79), p. 48-51), having 3 degrees of freedom However, all mentioned above simulators, including the last one, are not equipped with any stabilization (active balancing) system: athlete, unlike when rowing real boat, is not able to use oars to help himself to maintain a balance.

The aim of this invention—the extension of the functionality of lever type unstable rowing simulator by delivering the athlete the possibility to maintain the balance in the same way as it can be done in case of the boat floating in the water, that is by moving up and down the levers simulating oar handles.

SUMMARY OF THE PRESENT INVENTION

The aim is achieved by equipping the levers representing oar handles of the moveably suspended lever-type rowing (sculling) simulator able to sway around the longitudinal and other axes (that is unstable), by spikes that extend the levers behind the knuckles where the levers are attached to the simulator, and the viscous friction damping elements connecting the ends of the spikes with the stable base.

When the lever representing oar handle of unstable rowing simulator is moved upward the ending of its spike moves down due to lever rotation about knuckle and the viscous friction damping element is compressed herewith producing the resistance force proportional to the speed of its compression, i.e. speed of the oar handle lifting up, thus resulting in tilt of a simulator in the direction opposite to the side where the lever was lifted. This way an interaction of the oar with the water where boat is floating is simulated which is usually used to ensure the balance of the sculling boat-rower system.

BRIEF DESCRIPTION OF THE DRAWINGS

FIG. 1 shows the kinematic scheme of the unstable rowing (sculling) simulator with an active stabilization system controlled by oar handles movements.

DETAILED DESCRIPTION

The basis of unstable rowing simulator (FIG. 1) is the lever-type rowing machine 1. It's equipped with a movable (along main longitudinal beam 2 of cross-shaped frame) or fixed seat 3, and the levers 4, imitating oars handles, attached at the frame crossbar 5 ends by crutches 6. The beam 2 of the frame of rowing machine is suspended at the ends of longitudinal beam 7 of the cross-shaped base frame by means of elastic supports 8 (adjustable depending on weight and capacity of the athlete). The ends of the beam 2 are bed in spherical hinges 10 at the vertically movable upper parts 9 of supports 8.

The adjustable height rests 11 are used to restrict the amplitude of tilt of the roving machine about the longitudinal axis (passing through the centers of hinges 10), and the elastic supports 13 between the frames crossbars 5 and 12 are installed to facilitate the maintenance of a balance. The active control of the balance is ensured by means of viscous dampers 14, attached at one end to the base frame crossbar 12, and at the other—to the ends of spikes 15 of oars handles 4, protruding behind the crutches 6. The center of gravity of the athlete, sitting on a rowing machine seat 3, is above the longitudinal axle of its rotation about joints 10, so the system simulator-athlete is unstable: when the center of mass of the system departs from the vertical plane (when athlete leans on side itself, takes a list together with the rowing machine etc.) system loses the balance and rowing machine tilts around said axis until the appropriate end of the frame crossbar 5 leans on the upper end of the elastic support 13. Being compressed the elastic support 13 helps to maintain the balance, because reacts the tilting of rowing machine: if the stiffness is enough—until complete stop, otherwise—slowing down, until the simulator frame crossbar 5 leans on the adjustable rest 11 mounted nearby. Active balancing is actualized by using viscous damper 14. When the athlete lifts oar handles (levers 4) dampers 14 are being compressed and thus they generate resisting force, proportional to the compression rate, which is stabilizing force. This force helps to maintain a balance, because when the end of spike 15 of oar handle 4 is supposed to be restrained in vertical direction the further raising of oar handle 4 leads to raising the corresponding end of crossbar 5 what leads to restoring the balance.

The unstable rowing simulator can be used as stable exerciser if necessary. This is achieved by restraining the upper (vertically movable) parts 9 of front and rear supports 8 and setting adjustable rests 11 height so that the simulator frame crossbar 5 would recline on them.

The invention claimed is:

1. An unstable rowing simulator, comprising:

a stable base;

a lever type rowing machine comprising a frame with a central longitudinal beam and a crossbar, the frame resting on the stable base;

adjustable elastic supports supporting the lever type rowing machine on the stable base;

levers imitating oar handles attached to the lever type rowing machine at knuckles, the levers being equipped with spikes that extend the levers, the spikes being attached to the knuckles behind the knuckles; and viscous friction damping elements connected at one end to the stable base and at another end to an end of one of the respective spikes of the levers imitating oar handles, wherein, the adjustable elastic supports comprise i) one set of adjustable elastic supports for stabilizing roll and ii) one set of adjustable elastic supports for stabilizing pitch and vertical motion, and ends of the central longitudinal beam of the frame are mounted in spherical hinges at vertically movable upper parts of the adjustable elastic supports for stabilizing pitch and vertical motion, the vertically movable upper parts of the adjustable elastic supports being adjustable for stiffness.

2. An unstable rowing simulator, comprising:

a lever-type rowing machine (1) equipped with i) a main longitudinal beam (2), ii) a frame crossbar (5), iii) a seat (3), iv) levers (4) imitating oar handles attached to ends of the frame crossbar (5), and v) crutches (6) that attach the levers (4) at the ends of the frame crossbar (5);

a cross-shaped base frame comprised of a base longitudinal beam (7) and a base crossbar (12);

elastic supports (8) located at ends of the base longitudinal beam (7), the elastic supports (8) supporting ends of the main longitudinal beam (2), the elastic supports (8) being individually adjustable for weight of an athlete using the unstable rowing simulator, wherein top ends of the elastic supports (8) are movable, have an adjustable stiffness, and include spherical hinges (10), and the ends of the main longitudinal beam (2) are supported in the spherical hinges (10); and viscous friction damping elements (14) having a first end connected to the base crossbar (12) and an opposite second end connected to an end of a respective one of the levers.

3. The unstable rowing simulator of claim 2, further comprising:

adjustable height rests (11) that restrict an amplitude of tilt of the frame crossbar (5) about a longitudinal axis passing through centers of the spherical hinges (10); and further elastic supports (13) located between parts of the frame crossbar (5) and the base crossbar (12).

* * * * *